US006913262B2

(12) United States Patent
Berman

(10) Patent No.: US 6,913,262 B2
(45) Date of Patent: Jul. 5, 2005

(54) CARD GAME WITH NUMBERED CARDS

(75) Inventor: Lyle Berman, Minnetonka, MN (US)

(73) Assignee: Lakes Game Development, LLC, Minnetonka, MN (US)

( * ) Notice: Subject to any disclaimer, the term of this patent is extended or adjusted under 35 U.S.C. 154(b) by 0 days.

(21) Appl. No.: 09/975,907

(22) Filed: Oct. 12, 2001

(65) Prior Publication Data

US 2002/0043766 A1 Apr. 18, 2002

Related U.S. Application Data

(60) Provisional application No. 60/240,019, filed on Oct. 12, 2000.

(51) Int. Cl.[7] ..... A63F 1/12
(52) U.S. Cl. ..... 273/292; 273/149 R
(58) Field of Search ..... 273/292, 274, 273/249; 463/20–22; 243/149 R, 149 P

(56) References Cited

U.S. PATENT DOCUMENTS 4,443,012 A * 4/1984 Makovic et al. ..... 273/268
4,515,367 A * 5/1985 Howard ..... 273/149 R
5,224,712 A * 7/1993 Laughlin et al. ..... 273/304
5,695,189 A * 12/1997 Breeding et al. ..... 273/149 R
5,718,431 A * 2/1998 Ornstein ..... 273/274
5,810,355 A * 9/1998 Trilli ..... 273/149 R
5,829,749 A * 11/1998 Hobert ..... 273/274
5,904,353 A * 5/1999 Aldridge ..... 273/292
5,934,676 A * 8/1999 Rubin ..... 273/309
5,961,384 A * 10/1999 Robinson ..... 273/237
5,964,463 A * 10/1999 Moore, Jr. ..... 273/274
6,070,872 A * 6/2000 Squitieri ..... 273/274
6,139,014 A * 10/2000 Breeding et al. ..... 273/149 R
6,254,096 B1 * 7/2001 Grauzer et al. ..... 273/149 R
6,302,395 B1 * 10/2001 Astaneha ..... 273/146
6,325,373 B1 * 12/2001 Breeding et al. ..... 273/149 R
6,336,633 B1 * 1/2002 Webb ..... 273/146

OTHER PUBLICATIONS

John Scarne, Scarne's Encyclopedia of Games, 1973, Harper & Row, pp. 319–321.*

* cited by examiner

*Primary Examiner*—Derris H. Banks
*Assistant Examiner*—Alex F. R. P. Rada, II

(57) ABSTRACT

A method of dealing a card game is taught wherein cards representing dice having a least four sides are utilized using variations of rules for games such as 1) traditional craps game, 2) Four The Money game, high low craps, or roulette. By repeatedly shuffling either two sets of six cards numbered 1 through 6, or one set of 36 cards (representing all of the rolls of a set of two six sided dice) traditional craps rules may be followed. Also taught is a roulette game which is played by having cards representing the numbered slots of a roulette game. A user is allowed to pre-select a space from a plurality of spaces into which a pre-determined number of cards are dealt in order to determine the number generated in place of a dice roll while still allowing user interaction in the random decision. Electronic monitoring card numbers, storage of card numbers, and the display of prior outcomes is also discussed. Comparison of the stored information to wagers is made to determine when wagers are won.

15 Claims, 5 Drawing Sheets

CARD GAME WITH NUMBERED CARDS

PRIORITY STATEMENT

The patent claims priority based on Provisional Patent 60/240,019 filed on Oct. 12, 2000.

BACKGROUND OF INVENTION

1. Field of Invention

The invention relates to card games using the generation of numbers between a predetermined minimum and a predetermined maximum, such as craps, Four the Money, hi-low craps and roulette. More particularly the invention applies to playing a game of the type previously listed utilizing a card deck to generate random rolls and providing for unique features of tracking and displaying the results.

2. Prior Art

Dice games and card games are known in the prior art. Machines which automatically deal from decks and which randomly deal from certain position in a deck of cards are also known in the art.

GENERAL DISCUSSION OF THE INVENTION

The invention described herein is best understood as a novel method of playing and redesigning roulette or dice games (e.g. craps, Four The Money, High-Low Craps, etc.) by substituting numbered cards for traditional dice and utilizing modern shuffling technology and unique layouts to provide better, random results.

A technique for playing a wagering game is taught where at least one random number is needed in order to determine an outcome and wherein the number is determined by selecting at least one or more random numbers within a range and where the numbers are determined by mechanically dealing one or more cards where each card has at least two numbers or has a single number representing a plurality of numbers (alternatively, at least two cards are dealt and added together to get the result). One of the cards may even be replaced with a dice to vary the result.

One method of doing this would be to shuffle multiple sets of six cards where each set was numbered sequentially one through six so that the shuffle and subsequent deal acts numerically identically (statistically) to a six-sided dice.

A shuffling machine could shuffle the cards so that the sets of six would be shuffled together and could use random card selection technologies to randomly deal from the mixed decks. Modern shuffling technology for normal card decks may be adapted for these options.

The dealer could (1) deal out two or more (even all six cards) and turn over one for each dice or (2) deal out one of the 6 cards for each dice. In order to add various degrees of excitement, by way of example, the six cards could be set down in two rows of six each and then one card from each row could be turned up in order to get a dice roll for a game of craps, Four The Money, or High-Low Craps. To give the player the feeling of control, the deal need only deal two cards from which the selection of the player would be made since this would introduce a randomizing feature without dependence on a machine but would reduce the number of cards to be handled. Also, the display of the non-picked card could add to the angst which makes these games of chance so popular.

Likewise, only one of the cards could be dealt out with a set of thirty-six cards (each representing a roll of two dice) and that card could be the dice roll.

The two card method (1 sets of 2–6) could be set up so that a user could look at the six dealt cards dealt face down and select one to be turned up. To prevent marking, the players could select one space of 6 and the card dealt to that space would be the one turned up. In order to provide more excitement, it could be required that one player would select one card location and another player would select a second card location where two players were playing the game. If only one player were to play in the game, various similar methods of selecting the cards automatically could be established. In the preferred embodiment two six-sided dice are used. It can be seen that any number of dice sides or dice numbers could be utilized to a similar effect.

For Roulette, two extra cards would be required representing 0 and 00 in addition to the other numbers possible from a roulette wheel.

Under another method to practice to the invention where the outcome of two six sided dice are important, the game would be played having at least one of 36 cards dealt out reflecting the 36 combinations of two six sided dice and the dealer would turn one card up in order to represent the dice roll of the two dice. In one embodiment, all 36 dice could be shuffled and one or more dealt out of the set of 36 with a space selection being made before the deal. The same machine or a second machine with a like dice set (or with a more unusual game with a different type of dice set) could deal the next deal in a similar manner. Dice could be dealt from countless decks and recycled according to logical dealing sequences. Solid cards are envisioned, but electronic displays representing the cards could be used.

In one embodiment of the invention, all 36 combinations could be dealt and the players could pick rolls sequentially so that each time one was picked it was turned over. For Four The Money or High-Low Craps type games, this would allow the user to obtain a win or a loss based on (1) 4 cards without a seven, or (2) how many of the cards were turned up before a target number, usually seven with two six-sided dice, having 36 possible combinations.

A craps game may be set up so that the players sequentially take turns so that multiple players select cards to turn up, where one player turns up the cards until a terminating event (a seven after a point in traditional craps) or cards may be electronically selected to be turned up.

Because multiple cards are used in the invention, each card may be electronically or mechanically marked so that a sensor can determine what number is displayed. In this way, electronics may track the card displayed or the total displayed to track a series of card plays so that in games where multiple rolls or totals are requires (four the money or high roller of the month, for example) or series of rolls are important (different doubles, all or none at all), these may be tracked electronically. This is more difficult in traditional dice usage because the dice must be picked up and set on a location or number punched in for the same result. Here the cards need only be placed at the appropriate location when dealt.

It is therefore one purpose of the invention to provide for a game which follows rules of various gaming-type dice games utilizing cards and utilizing a novel method of shuffling, dealing and displaying the cards in order to attempt to maintain the statistical variation in existing dice games and in order to provide new rules allowing for greater player entertainment and selection.

These and other objects and advantages of the invention will become better understood hereinafter from a consideration of the specification with reference to the accompanying drawings forming part thereof, and in which like numerals correspond to parts throughout the several views of the invention.

BRIEF DESCRIPTION OF THE DRAWINGS

For a further understanding of the nature and objects of the present invention, reference should be made to the following detailed description taken in conjunction with the accompanying drawings in which like parts are given like reference numerals and wherein.

DETAILED DESCRIPTION OF THE PREFERRED EXEMPLARY EMBODIMENTS

Figure 1:
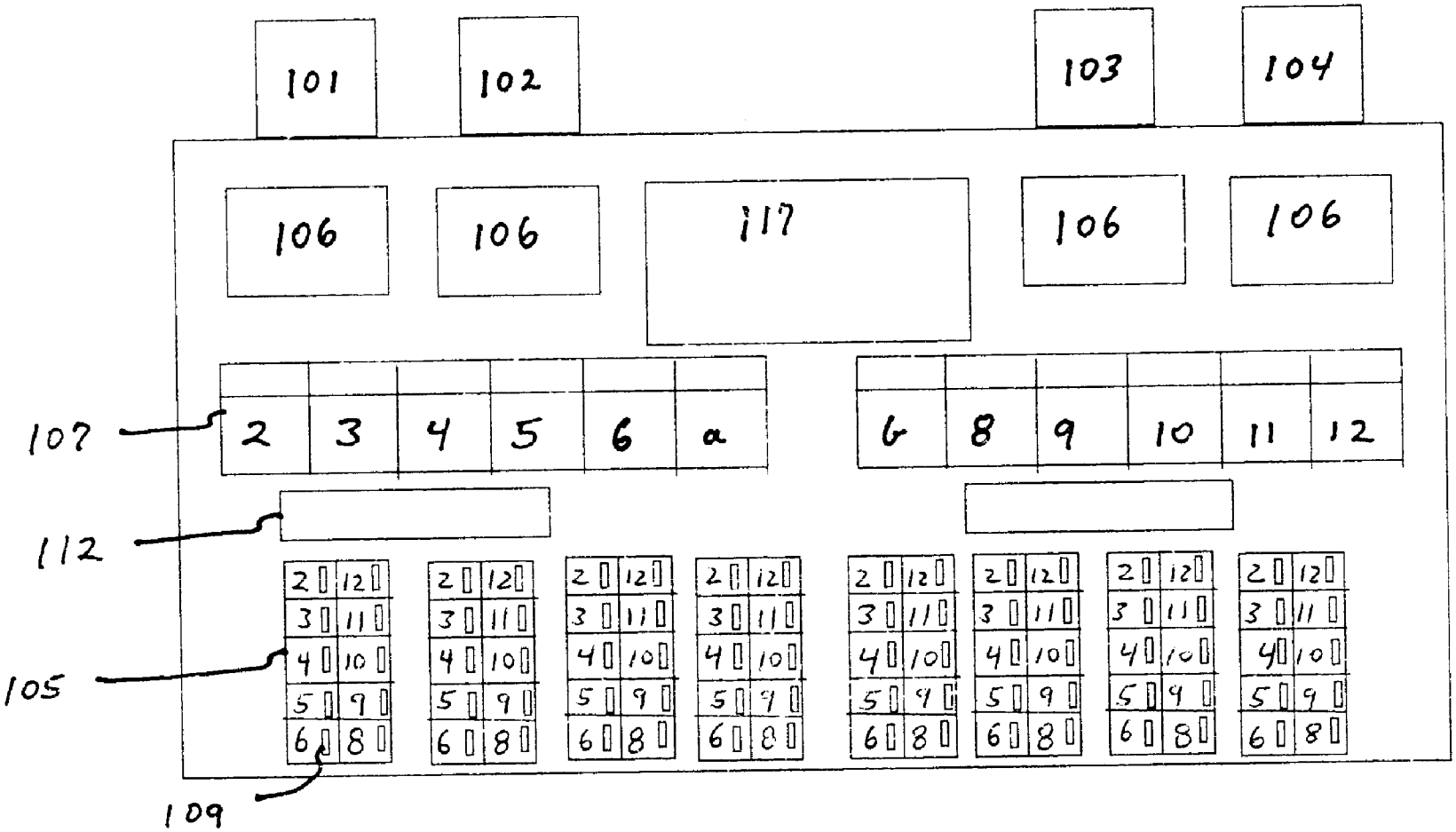
FIG. 1 shows a layout for the preferred embodiment showing a plurality of dealing machines although only a single dealing machine is necessary to practice the invention.

As can best be seen by reference to FIG. 1 in the preferred embodiment there are four card dealing machines 101 through 104. In front of each of these, is a space, card holding location 106 to receive one or more cards. Betting locations are available on the table. One betting location 107 which is here shown as a traditional odds wager location, which is typically served exclusively by the dealer. Also shown are user betting locations 105, here a Four The Money odds wager layout. Here, the odds wager layout shows slots 109 for wagers to be placed and held. These slots 109 may not take money; they may simply serve to hold the wager until the end of the betting period to prevent manipulation of wagers or to prevent these wagers from being disturbed by dice rolls. The slots 109 may also allow the house to track which bets have been made so that the game can identify winning wager and losing wagers by lighting the space when a win or lose occurs to ease the handling of multiple wagers of this type. While slots 109 are shown for this purpose, it is also clear that these slots 109 could be replaced with sensors of other types which sense the presence of a wager at the locations where the slots 109 are shown.

Each wager location allows the player a place to put a wager on a place to put a wager on a statistical event. For example, a "come bet" allows a wager that a 7, 11 or repeat of a point will occur before a "craps" roll on the "come out" roll or a 7 after the "come out" roll but before the repeat of the point.

Figure 8A:
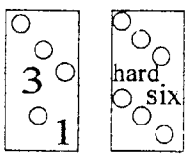
FIG. 8*a* shows two cards of an alternate type usable when one card represents two dice.
Figure 8:
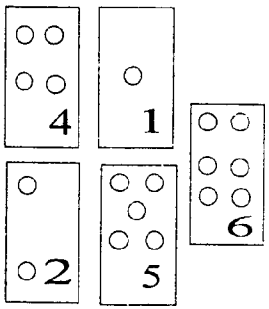
FIG. 8 shows a set of six numbered cards having dots and numeric displays of quantity.
Figure 2:
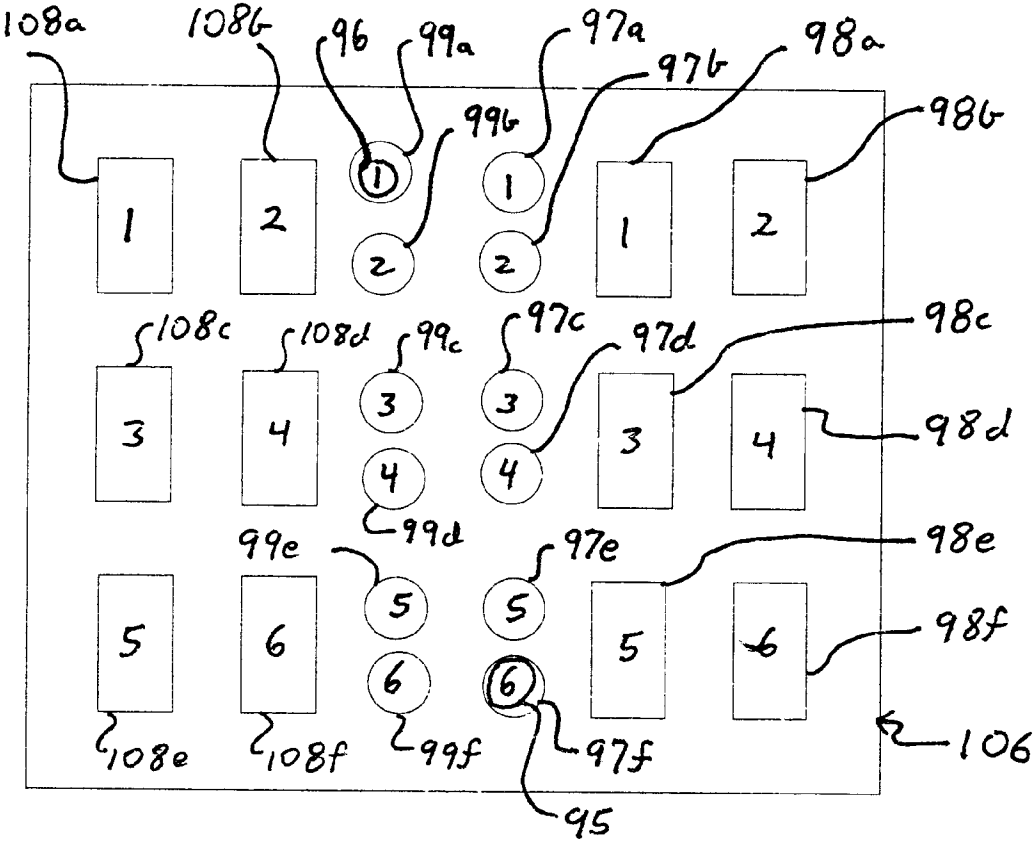
FIG. 2 shows one embodiment of the layout shown at 106 shown in FIG. 1.

FIG. 2 shows one method of defining the card holding location 106. In this embodiment, there are marker spaces 99*a*–99*f* and 97*a*–97*f* which serve to hold markers 96 and 95 respectively. These markers 95 and 96 are placed on one of the marker spaces 99*a*–99*f* and on one of the marker spaces 97*a*–*f* before the deal. Up to six cards may be dealt to locations 108*a*–108*f* and 98*a*–98 *f*. The card on the space with a number corresponding to the marker 95 and 96 is the selected card and the two cards are added to determine the value of the resulting deal. These cards are shown in FIG. 8.

In the example shown, marker 96 marks space99*a* and marker 95 marks space 99*f* so that cards (not shown) dealt to card location 108*a* and a card (not shown) dealt to card location 98*f* would be the selected cards. In this example if a "3" was dealt to 108*a* and a "4" dealt to location 98 *f*, then the total of 7 is the resulting roll or deal. By way of alternate example, if card 3 is dealt to location 108*a* and another card 3 is dealt to location 98 *f*, in this example of the layout, the total would be a 6 "hardway" or a "hard six".

Figure 3:
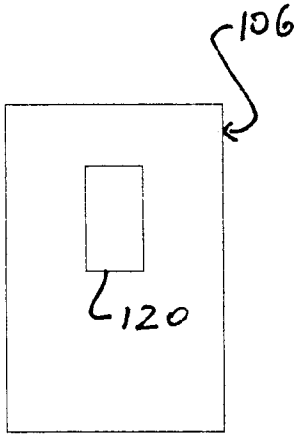
FIG. 3 shows one embodiment of the layout shown at 106 for FIG. 1.

If 36 cards are simultaneously shuffled, reflecting each of the 36 possible outcomes with two six sided dice, then the outcomes may be dealt to a first single location 120 shown on FIG. 3 as one alternate embodiment of the cards holding location 106. These cards are shown in FIG. 8*a*.

Figure 4:
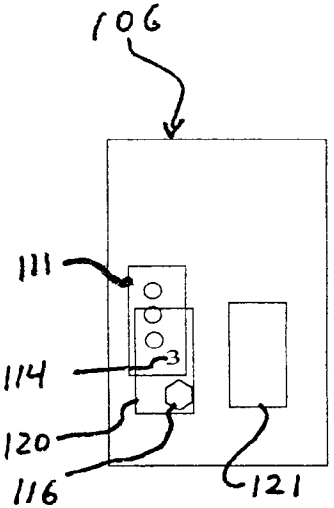
FIG. 4 shows one embodiment of the layout shown at 106 for FIG. 1.

If two cards are dealt to get the total, but the user does not preselect the space to which it is dealt, the layout shown in FIG. 2 can be replaced with the layout shown in FIG. 4 where there is a first single location 120 and a second single location 121 which will receive one of the six sided dice numbers.

The card holding locations may work in several different manners in accordance with the disclosure herein. Six locations 108*a*–*f* are shown so that six different card dice rolls may be displayed and one of those may be pre-selected with a marker 96 on spaces 99*a* –*f*. Where two sets of cards are used, each having the numbers sequentially on through six, there may be a second set of six locations 98*a*–*f* to display the next six cards. The same marker 96 for both groups of locations (108*a*–*f* and 98*a*–*f*) or two different markers 95 and 96 for locations 108*a*–*f* and 98*a*–*f*, respectively, may be used to get the same statistical result.

Similarly, a card may be turned up either according to its location after it is dealt, by being specified by the user or, as set forth above in the preferred embodiment, it the location may be selected before the cards are dealt. It should also be noted that while locations for all six cards are shown, only two cards need be dealt, if dealt randomly, to allow for user selection to play a roll in the random outcome.

Also, a single "roller" may select the card to turn or it may be selected by majority vote of multiple players. The selection process may occur before every roll or may be made once and apply to all deals until a terminating event.

The purpose for having the determination as to which spot would have the card to be turned up before the cards were dealt would be to prevent the possibility of any marking of the cards interfering with the random of nature of the game.

A single card may be dealt from the top of the deck or at a random location determined by a dealing machine. In a situation where each of the card dealing machines 101 through 104 deals out a single card from 36 cards this one location 120 will display a card corresponding to one of the rolls of the two dice (Examples are shown in FIG. 8*a*). The cards may be marked sequentially from two single dots (a "2") to two six dots (a "twelve") so that all possible 36 combinations, of two six sided dice are shown. Where multiple decks are used, a wild card may be included. In one example, using traditional dice, instead of one set of 36 cards, two (or more) sets of 36 cards could be used. The statistical odds of any roll would be the same (one in 36). One of the cards, however, could bear a special character (not shown) such as a dollar ("$") sign. The odds of this card appearing would be one in 72 (in this example) and a bonus could be paid on it's appearance. This bonus could be the subject of an additional wager or could be a bonus on the wagers within the game.

FIG. 4 shows where decks of six cards are used. A card is dealt to space 120 for the first card and space 121 for the second card and the spaces are added for a total. This shown where the space 120 has a sensor 116 to read a numeric or electronic number marker 114 on the card 111 (here a three).

Figure 5:
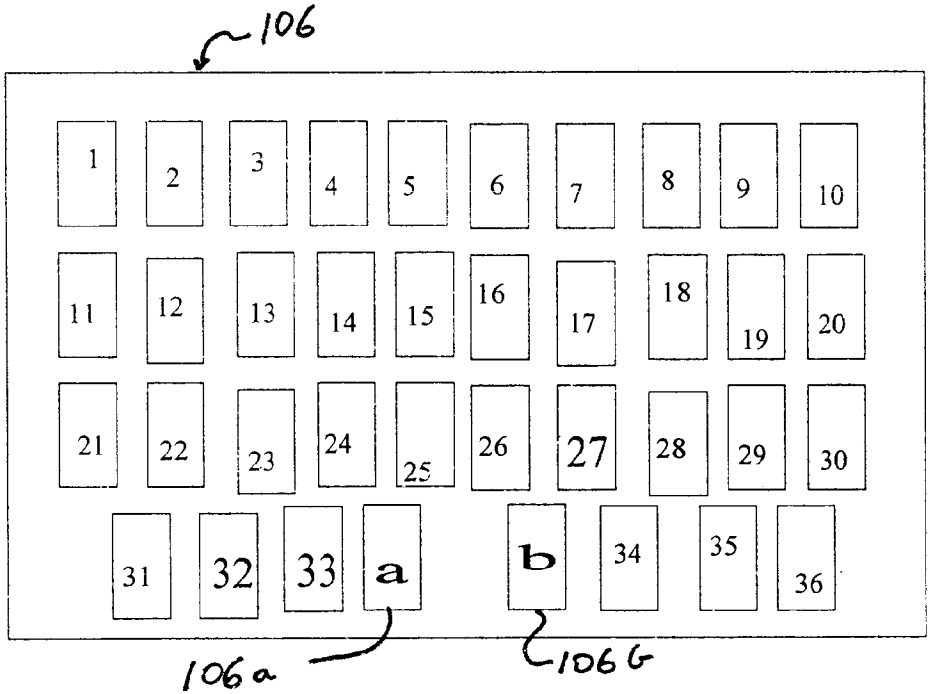
FIG. 5 shows one embodiment of the layout shown at 106 for FIG. 1.

FIG. 5 shows a modification of the display shown in FIGS. 3 and 4 where all combinations (36 in a typical two six sided dice combination) are dealt. The player makes a selection of which space is used according to the rules specified. In this layout the user could select one of the 36 numbers until a 7 was displayed (high low craps). If more than 36 numbers are used extra spaces, here 106*a* and 106*b*, may be provided to receive these cards. These extra spaces 106*a* and 106*b* may, alternatively, be used to accept cards which are terminating events so that the terminating event may change in accordance with the deal to these spaces. For example, if a six and a ten were dealt to spaces 106*a* and 106*b*, the deal could terminate upon up a six or ten.

In addition to utilizing cards in this technique, a random number generator may be utilized in order to display the numbers in the spaces provided in the form of cards or dice in the layouts embodied herein. In the example shown in FIG. 5, blank cards could cover the spaces displaying the numbers selected which could be sequentially lifted according to the choice of the player.

Figure 6:
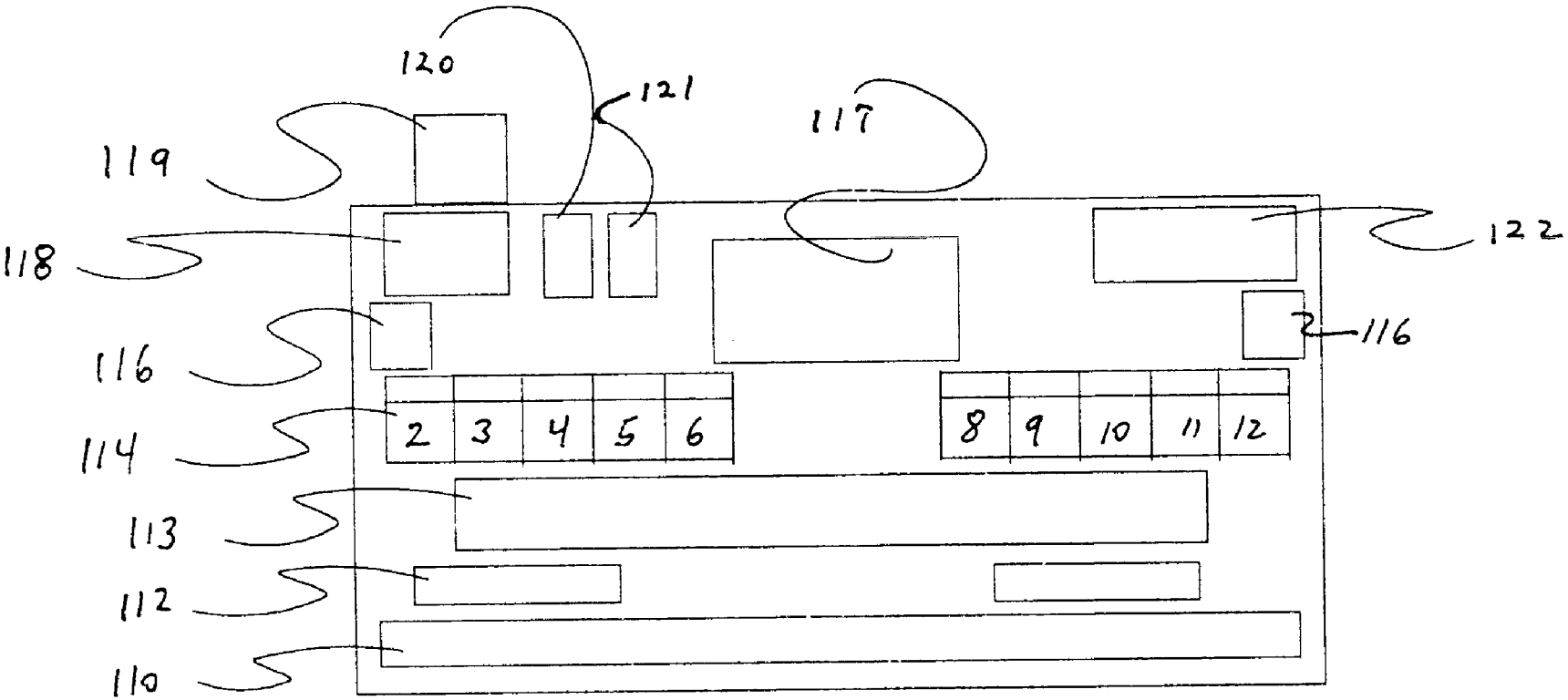
FIG. 6 shows a layout for a single dealing machine.

Since the invention may be played with a single dealing machine, FIG. 6 shows an embodiment where a single dealing machine 118 deals two cards numbered 1–6 to a first location 120 and a second location 121 in order to determine a roll. A shuffling machine 119 of the type known in the art is provided to deal one deck of numbered cards while the other decks are dealt by the dealing machine 118. The dealer stands behind a chip rack 117. In this embodiment, a craps type game is played having a pass line 110, a don't pass/don't come location 115, a come line 113 as well as a location for field type bets 112 and odds wagers 114. The exact layout may be identical to a craps layout with the addition of the dealing machines 118, shuffling machine 119 and card display areas, here locations 120 and 121. A tracking display 122 showing the total of the current roll or the rolls in the series of the rolls before a terminating event may be provided. This display 122 may obtain the total of the cards through markings on the cards readable on the display areas 120 and 121 as described in more detail in reference to FIG. 4 above.

A first wager location for accepting a wager on at least one statistical event associated with the random generation of dice tolls according to a set of rules based on statistical odds is required for most games of this type. Typically this is a "come" location 110.

Figure 7:
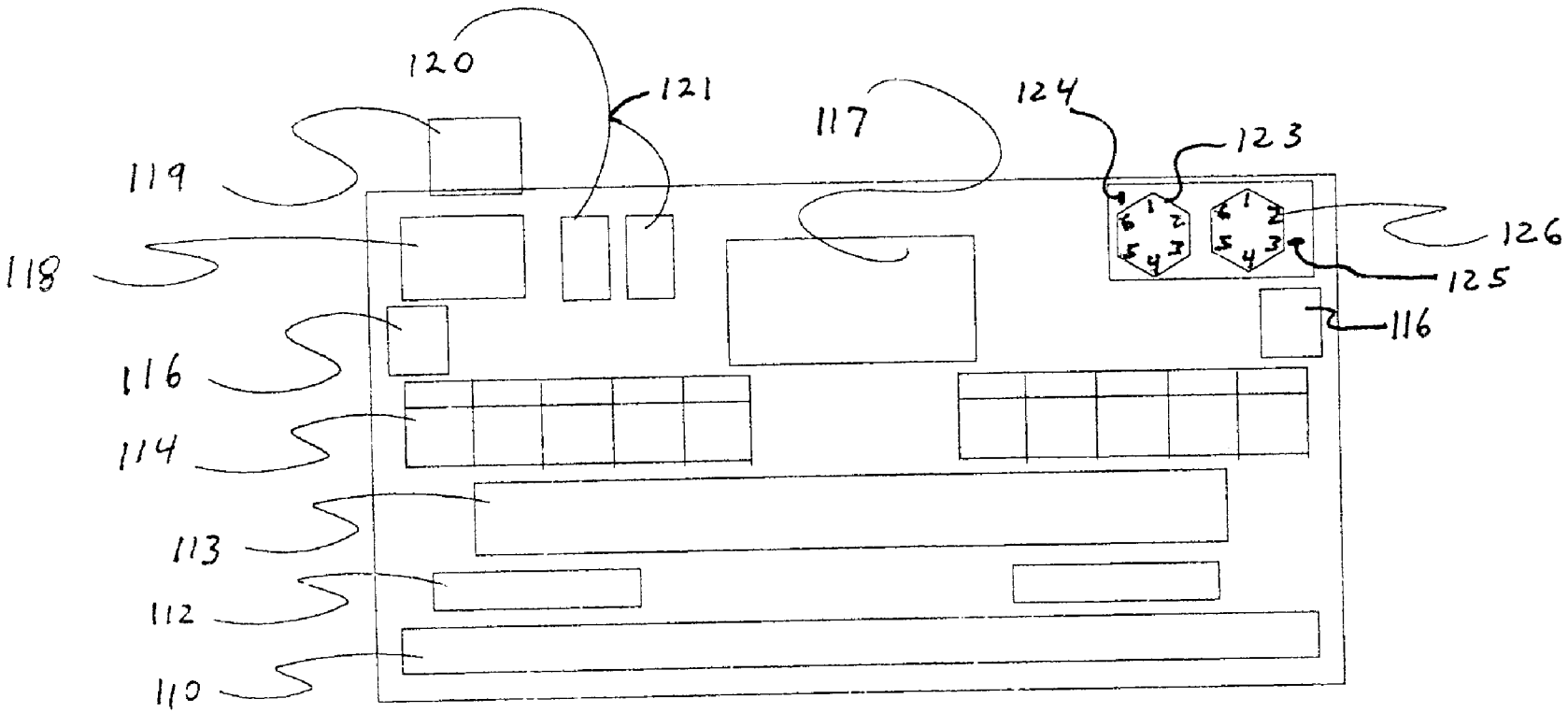
FIG. 7 shows a layout which includes an alternate dice means.

FIG. 7 shows another alternate embodiment based around the general display shown in FIG. 6 wherein the dice rolls may be obtained through alternate dice means 123 and 126, here six sided wheels123 and 126, wherein the roll is determined by the numbered positions on the wheels relative to pointers 124 and 125. In this way, the card mechanism is used in conjunction with another mechanism to increase the interest in the game and to accelerate play.

FIG. 8 shows a set of six numbered cards having dots and numeric displays of quantity for the numbers one through six. FIG. 8*a* shows two cards of an alternate type usable when one card represents two dice. By way of example, one card shows a 3-1 combination to make 4 and the other card shows a 3-3 combination to make a "hard six".

Because many varying and different embodiments may be made within the scope of the inventive concept herein taught and because many modifications may be made in the embodiment(s) herein detailed in accordance with the descriptive requirements of the law, it is to be understood that the details herein are to be interpreted as illustrative and not in a limiting sense.

What is claimed is:

1. I claim a game for at least one player comprising the steps of:

a) preparing at least one first deck of cards representing the possible outcomes from a dice means for determining a random number between a predetermined minimum and a predetermined maximum;

b) preparing at least one second deck of cards representing the possible outcomes from a dice means for determining a random number from a predetermined minimum and predetermined maximum;

c) providing at least one first wager location and at least one second wager location for accepting a wager on at least one statistical event associated with the random generation of dice rolls according to a set of rules based on statistical odds of the occurrence of specific dice rolls;

d) accepting at least one wager on the at least one first wager location;

e) selecting at least one first card from the at least one first deck at random using an electromechanical playing card handling apparatus for randomly shuffling and dealing the at least one of said cards;

f) displaying the at least one first card;

g) satisfying wagers if the at least one first card matches the at least one statistical event;

h) accepting at least one wager at least one second wager location;

i) selecting at least one second card at random using an electromechanical playing card handling apparatus for randomly shuffling and dealing the at least one second card from the at least one second deck;

j) displaying the at least one second card;

k) satisfying the at least one second wager if the at least one second card matches the at least one statistical event.

2. The game of claim 1 wherein the at least one first deck further comprises at least one third deck of cards representing the outcome from a dice means for determining a random number between a predetermined minimum and a predetermined maximum and wherein the step of selecting at least one first card at random further comprises selecting at least one first card at random using an electromechanical playing card handling apparatus for randomly shuffling and dealing the at least one first card and selecting at lest one second first card from the at least one third deck of cards using an electromechanical playing card handling apparatus for randomly shuffling and dealing; and wherein the step of displaying further comprises the step of displaying the at least one first card second card and wherein the step of satisfying wagers comprises the step of adding the at lest one first card and at least one second first card together to determine if the at least one statistical event has occurred.

3. The game of claim 2 wherein at least one statistical event is determined from the statistical events utilized in playing a game from the group comprised of 1) a traditional craps game, 2) a Four The Money game, 3) a high roller of the month game, 4) a high low craps, and 5) a roulette game.

4. The game of claim 3 wherein the first set of cards and third deck of cards represent the possible outcomes with a first and second dice having 6 sides.

5. The method of claim 3 wherein the at least one first deck comprises a first first deck and a second first deck and the at least on second deck comprises a first second deck and a second second deck and wherein the step of selecting comprises selecting a first card from the first first deck and a second card from the second first deck and selecting a first card from the first second deck and a second card from the second second deck and adding the first and second cards from the first and second decks to get an outcome from each deck.

6. The method of claim 2 wherein the step of selecting further comprises:

l) preparing a table with a plurality of card locations for receiving at least three cards from each deck comprising a first card location, a second card location and at least one third card location;

m) dealing at least one first first card at lest one second first card and at least one third first card to the plurality of card locations;

n) allowing the at least one player to select two of the plurality of card locations and not select at least one of the plurality of card locations to select two play cards; and o) adding the two play cards to determine the outcome.

7. The game of claim 6 further comprising the step of removing and reshuffling the at least one first deck of cards and dealing at least one first second card and at least one second second card and at least one third second card from the at least one second deck of cards to the plurality of card location;

b) allowing the at least one player to select at least two of the plurality of card locations and not select at least one of the plurality of card location so as to select at least two play cards;

c) adding the two play cards to determine a dice roll outcome.

8. The game of claim 1 further comprising at least one special card which represents an object other than a number between the predetermined minimum and predetermined maximum and wherein the display of the special card provides a bonus to the wager.

9. The game of claim 8 wherein the bonus is from the group consisting of (1) allowing the player to pick any number from at least one number between the predetermined minimum and predetermined maximum for the value of the special card, (2) providing a multiple payout on wagers, (3) providing a special payout not related to a wager on the occurrence of the special card, (4) providing a special payout related to a wager on the occurrence of the special card, (5) triggering an event to select an additional play, and (6) triggering an event to randomly select an additional amount.

10. The game of claim 8 wherein the special card also bears a number between the predetermined minimum and pre-determined maximum.

11. The game of claim 1 wherein the step of selecting further comprises the step of selecting at least one first first card and at least one second card and wherein the at least one first card and at least one second card each represent a dice roll and wherein the step of displaying further comprises a) preparing a table with a plurality of card locations comprising at least one first card location and at least one second card location for receiving the at least one first card and the at least one second card;

b) dealing the at least one first card and the at least one second card to the at least one first card location and at least one second card location respectively;

c) allowing the at least one player to select a location from between the at least one first card location and at least one second card location;

d) displaying the card in location selected by the at least one player.

12. The method of claim 1 further comprising repeating steps c through k until a predetermined target number is generated as the statistical event.

13. The method of claim 1 further comprising the steps of (1) marking the value of the at least one first card with an electronically readable value, (2) electronically examining the cards to locate the marking, and (3) electronically displaying the value.

14. The method of claim 1 wherein the step of preparing further comprises marking cards with at least two colors; and wherein the step of accepting further comprises the step of accepting wagers on the occurrence of a particular number or a group of numbers or a color.

15. The method of claim 1 wherein the handling apparatus in step (I) further comprises at least one second handling apparatus.

* * * * *